US007207094B2

(12) United States Patent
Meinhardt et al.

(10) Patent No.: US 7,207,094 B2
(45) Date of Patent: Apr. 24, 2007

(54) HOUSING

(75) Inventors: Martin Meinhardt, Reutlingen (DE); Daniela Märki, Horgen (CH)

(73) Assignee: SSM Schärer Schweiter Mettler AG, Horgen (CH)

( * ) Notice: Subject to any disclaimer, the term of this patent is extended or adjusted under 35 U.S.C. 154(b) by 42 days.

(21) Appl. No.: 11/138,607

(22) Filed: May 26, 2005

(65) Prior Publication Data

US 2006/0010668 A1 Jan. 19, 2006

(30) Foreign Application Priority Data

May 29, 2004 (EP) ..... 04012862

(51) Int. Cl.
*D02J 1/08* (2006.01)

(52) U.S. Cl. ..... 28/271; 28/247

(58) Field of Classification Search ..... 28/271, 28/272–276, 247, 268, 220; 57/350, 333, 57/3

See application file for complete search history.

(56) References Cited

U.S. PATENT DOCUMENTS 3,167,847 A 2/1965 Gonsalves
3,675,623 A * 7/1972 Taylor ..... 28/271
3,713,509 A 1/1973 Carroll
4,014,489 A * 3/1977 Bialek ..... 28/271
4,031,690 A * 6/1977 Thomas et al. ..... 57/1 R
4,043,008 A * 8/1977 Weiss et al. ..... 28/271
4,110,876 A 9/1978 Weiss et al.
4,188,691 A * 2/1980 Matsumoto et al. ..... 28/271
4,223,520 A 9/1980 Whitted et al.
4,563,965 A * 1/1986 Gregory ..... 112/302
5,913,976 A * 6/1999 Patton et al. ..... 28/271

FOREIGN PATENT DOCUMENTS

DE 41 13 926 A1 11/1992
JP 200303292 10/2000
JP 2000303292 A 10/2000
WO WO 90/11395 10/1990

* cited by examiner

*Primary Examiner*—Amy B. Vanatta
(74) *Attorney, Agent, or Firm*—Walter A. Hackler

(57) ABSTRACT

A housing 1 for enclosing a nozzle is suggested, particularly an air covering nozzle or an air texturing nozzle 3, with at least one filament pass-through aperture 10, 11, 12, 13 having a filament pass-through aperture circumference 20 and a housing cover 5 that covers a housing opening in a housing base 15, housing cover 5 engaging with housing base ridges 18 on housing base 5 by means of cover ridges 17, filament pass-through aperture 10, 11, 12, 13 being located in such manner on one of the housing base ridges 18 that part of filament pass-through aperture circumference 20 is formed by one of the cover ridges 17.

6 Claims, 2 Drawing Sheets

HOUSING

BACKGROUND OF THE INVENTION

The invention relates to a housing for encasing a nozzle, particularly an air covering nozzle or an air texturing nozzle, with at least one filament pass-through aperture having a filament pass-through aperture circumference and a housing cover that covers a housing opening in a housing base, the housing cover engaging with housing base ridges on the housing base by means of cover ridges. A housing of such kind is referred to as a soundbox and is used in yarn processing machines particularly to deaden the operating noise produced by the nozzle.

Yarn processing machines with an air covering nozzle (air covering machine) are used to combine filament yarns in a resilient, multi-component yarn (air covering yarn). In this process, the components of at least one sheath yarn (effect yarn) are combined with a core yarn. The objective of this process is to achieve the most uniform connection nodes possible in the multi-component yarn, and thus to combine the components. An example of an air covering machine is disclosed in U.S. Pat. No. 6,405,519 B1. The core filament is usually a yarn containing an elastomer. The sheath filaments may include various effect yarns. The filament yarns, that is the sheath yarns and the core yarn, are fed to an air covering nozzle via drawing mechanisms, e.g. godets. After the multi-component yarn has passed through the air covering nozzle, it is collected on a spindle, round which the yarn is wound. Before being wound, the multi-component yarn may be stretched, fixed, shrunk and/or scrooped. In the air covering nozzle, the sheath filaments are combined with the core filament with the aid of an air jet. For this, the air jet is directed in a direction that is not parallel to an air covering nozzle axis of the air covering nozzle. The air covering nozzle axis of the air covering nozzle is defined by a channel in which the filament yarns are guided through the air covering nozzle. According to the prior art, at least the core filament is guided into the air covering nozzle parallel to the air covering nozzle axis via a filament feed guide. Ideally, the sheath filaments are also guided into air covering machines with an infeed direction that is at least approximately parallel to the air covering nozzle axis.

Yarn processing machines for processing filament yarns with an air texturing nozzle (air texturing machine) are also known. Such an air texturing machine is disclosed in German Patent No. DE 39 09 516 A1. Air texturing machines are used to crimp smooth, unstructured filament yarns to lend them resilience. Multiple base yarns (core yarns) may be worked together with effect yarns of various origins to create a textured yarn. Unlike an air covering machine, the filament yarns in air texturing machines are always fed into the air texturing nozzle with feed directions that form an acute angle with an air texturing nozzle axis, i.e. into a channel of the air texturing nozzle that defines the axis of the air texturing nozzle, through which the filament yarns are passed. Ideally, the infeed direction of the effect yarns forms a right angle with the infeed direction of the core yarns, the air texturing nozzle axis forming a 45 degree angle with the infeed directions of both the effect yarns and the core yarns.

The nozzle, that is to say the air covering nozzle of the air texturing nozzle of a yarn processing machine of such kind, is mounted in a housing. The housing both protects the nozzle and damps the operating noises that are created when the nozzle is in operation. Known housings including filament pass-through apertures in a base of the housing and a housing cover. The housing cover protects a housing opening in the housing base, and the housing cover is attached to ridges in the housing base by ridges in the cover. The cover enables work on the nozzle and/or other assemblies mounted in the housing to be carried out through the housing opening. In addition, the filaments to be processes, that is to say the core filament and the sheath filaments, must be guided through the filament pass-through apertures so that they reach the nozzle. The filaments must also be fed to the nozzle with the housing cover open, since the respective yarn end must be seized for this purpose inside the housing. In order to achieve the greatest possible insulation within the housing, the filament pass-through apertures must be very narrow. Accordingly, feeding the filaments through these apertures is very time-consuming, and must be carried out with the aid of a special suction nozzle. As a consequence, the known housings are associated with substantial production losses while the filaments are being fed into the housing.

The task underlying the present invention is to provide a housing for enclosing a nozzle that not only avoids the drawbacks of the prior art but particularly enables rapid feeding of the filaments to be processed.

SUMMARY OF THE INVENTION

This task is solved by the housing of the main claim. The subordinate claims present preferred embodiments of the invention.

The housing according to the invention for enclosing a nozzle, particularly an air covering nozzle or an air texturing nozzle, has at least one filament pass-through aperture having a filament pass-through aperture circumference and a housing cover. The housing cover covers a housing opening in a housing base. The housing cover engages with housing base ridges on the housing base by means of ridges on the cover. Accordingly, the cover ridges are conformed in complementary manner to the housing base ridges, so that when the housing cover is closed the housing is completely insulated except for the filament pass-through apertures. According to the invention, the filament pass-through aperture is arranged on one of the ridges of the base housing in such manner that the circumference of the filament pass-through aperture is partly formed by one of the cover ridges. In this way, when the housing cover is opened away from the housing base, that is to say when the housing aperture is open, the circumference of the filament pass-through aperture (filament pass-through aperture circumference) is split into two. As a result, a filament no longer has to be fed in, but may simply be inserted, preferably from the side in the part of the filament pass-through aperture circumference on the housing base ridge. This also means that the suction nozzle is no longer needed. As a result, considerable time is saved and production stoppages are reduced.

The filament pass-through apertures are preferably arranged in the housing relative to a mounting position of the nozzle such that the filament pass-through apertures are oriented in the filament infeed directions of the nozzle. Therefore, the filaments do not need to be redirected inside the housing. The filament pass-through apertures may be arranged in such manner that the housing according to the invention may be used to enclose both an air covering nozzle and an air texturing nozzle. For this purpose, four or more filament pass-through apertures must be suitably arranged in the housing. A yarn processing machine equipped with a housing of such kind may then be used both either as an air covering machine or an air texturing machine simply by fitting it with the corresponding nozzle.

A dogtooth is preferably arranged at the filament pass-through aperture or apertures in the housing. A dogtooth is a filament guidance mechanism in which two semicircular hooks engage with one another. One filament may be fed into the dogtooth by being hooked into one of the hooks. A clasp arrangement on the hooks prevents the filament from slipping out. While the housing cover is open, the dogtooth holds in place the filament that is inserted from the side in the part of the filament pass-through aperture circumference on the housing base ridge. This makes it yet easier to feed, or in the case of an air covering nozzle to insert, the filaments in the nozzle.

The housing base and/or the housing cover is advantageously reinforced in the area of the filament pass-through aperture. The filament pass-through aperture then forms an extended channel. This serves to reduce the level of noise escaping from the housing according to the invention through the filament pass-through aperture.

In order to be able to monitor the process even when the cover is closed, the housing preferably has an inspection window in the housing cover.

The housing cover is preferably attached to the housing base by a hinge. This enables the housing cover to be closed quickly, since the mating parts of the filament pass-through aperture circumference of a filament pass-through aperture may be brought together precisely by the hinge when the cover is closed.

In the following, the invention will be explained in more detail on the basis of exemplary embodiments and with reference to the drawing.

Figure 1:
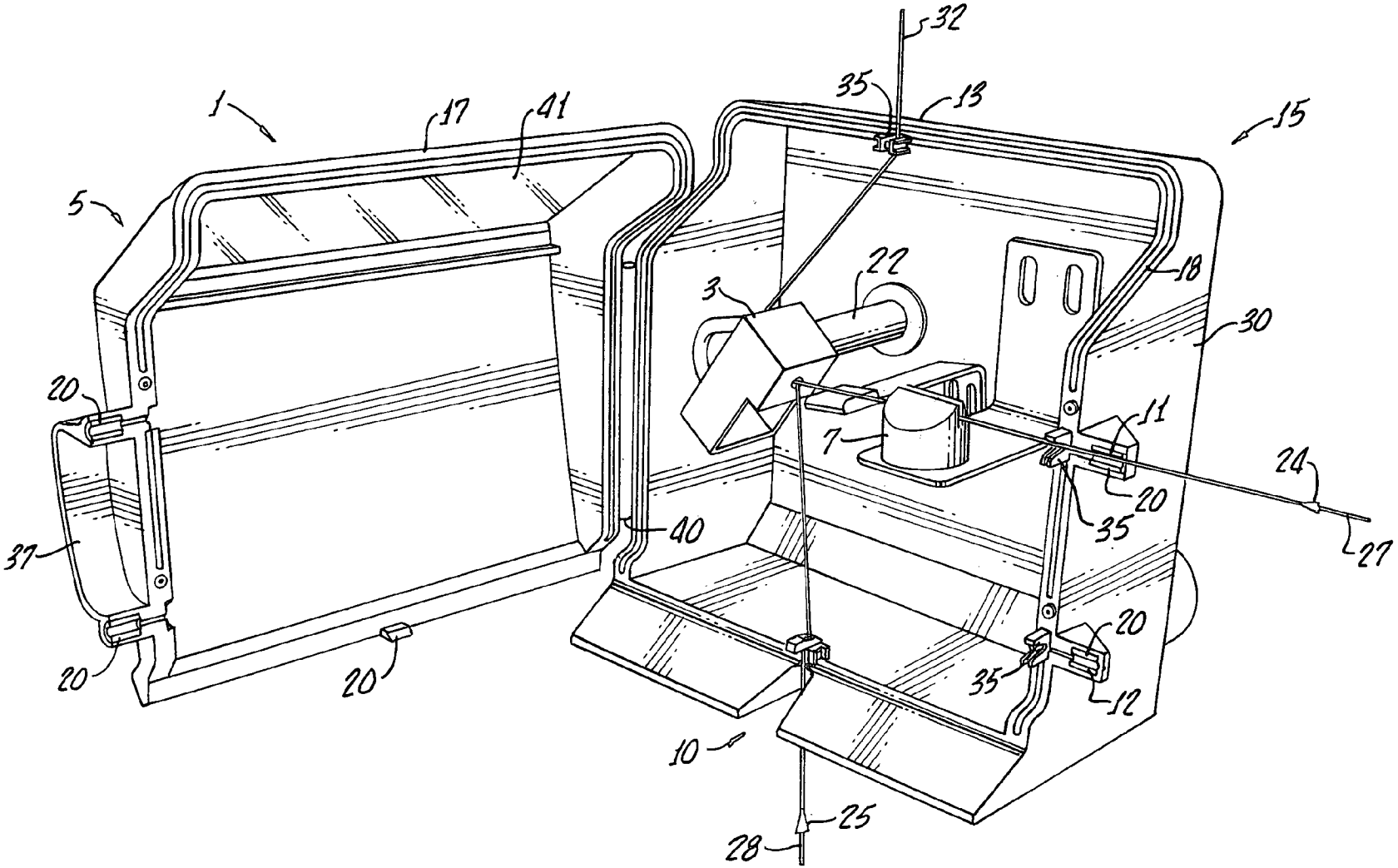
FIG. 1 shows a housing according to the invention with a mounted air texturing nozzle and with an open cover.

The figures of the drawing represent a highly stylized illustration of the object of the invention and are not drawn to scale. The individual components of the object of the invention as shown so that their construction may be clearly seen.

DESCRIPTION OF THE PREFERRED EMBODIMENT

FIG. 1 shows a housing 1 according to the invention, with an air texturing nozzle 3 mounted therein, with open housing cover 5. A wetting mechanism 7 is also mounted inside housing 1. Wetting mechanism may be used for example to moisten the filaments as they pass through it, before they pass through air texturing nozzle 3. Housing 1 is furnished with four filament pass-through apertures 10, 11, 12, 13. Housing cover 5 is shaped such that when closed it entirely seals the housing opening in a housing base 15. When closed, the housing ridges 17 of housing cover engage with the ridges 18 on the housing base to provide complete insulation. Cover ridges 17 are shaped to mate with ridges 18 on the housing base for this purpose. A gasket may be provided between cover ridges 17 and housing base ridges 18. Filament pass-through apertures 10, 11, 12, 13 are located on housing base ridges 18. In this way, each cover ridge forms one half of the circumference of the filament pass-through apertures (filament pass-through aperture circumference 20). The matching half of each filament pass-through aperture circumference 20 is formed by an opposing ridge on the housing base when the cover is closed. Filament pass-through apertures 10, 11, 12, 13 are positioned relative to a mounting position 22 of the nozzle (nozzle mounting position) in housing 1 so that filament pass-through apertures 10, 11 are located in filament infeed directions 24, 25 of the nozzle. In the example shown, including air texturing nozzle 3, infeed directions 24, 25 of a core filament 27, which are indicated in the drawing by with arrows on the corresponding filaments, and of a sheath filament 28 form a right angle. Accordingly, one filament pass-through aperture 10 is positioned centrally under mounting position 22 for air texturing nozzle 3 and one filament pass-through aperture 11 is positioned centrally on the housing base ridge of a side wall 30 on the right of housing 1. A further filament pass-through aperture 12 is located in the lower part of the housing base ridge on the side wall 30 on the right. This filament pass-through aperture is in a filament infeed direction of filaments in air covering processing. The housing 1 shown may therefore be used both for air covering processes and for air texturing processes. Yarn 32 that has been processed by air texturing nozzle 3 is drawn out through the fourth filament pass-through aperture 13, which is located on the upper ridge of the housing base above air texturing nozzle 3, and may then be wound on a spindle, for example. A dogtooth 35 is located at filament pass-through apertures 10, 11, 12, 13 inside housing 1. Additionally, housing base 15 and housing cover 5 are reinforced in the area of filament pass-through apertures 11, 12 on the right side wall 30. Housing cover 5 is attached to housing base 15 by a hinge 40 and has an inspection window 41.

Figure 2:
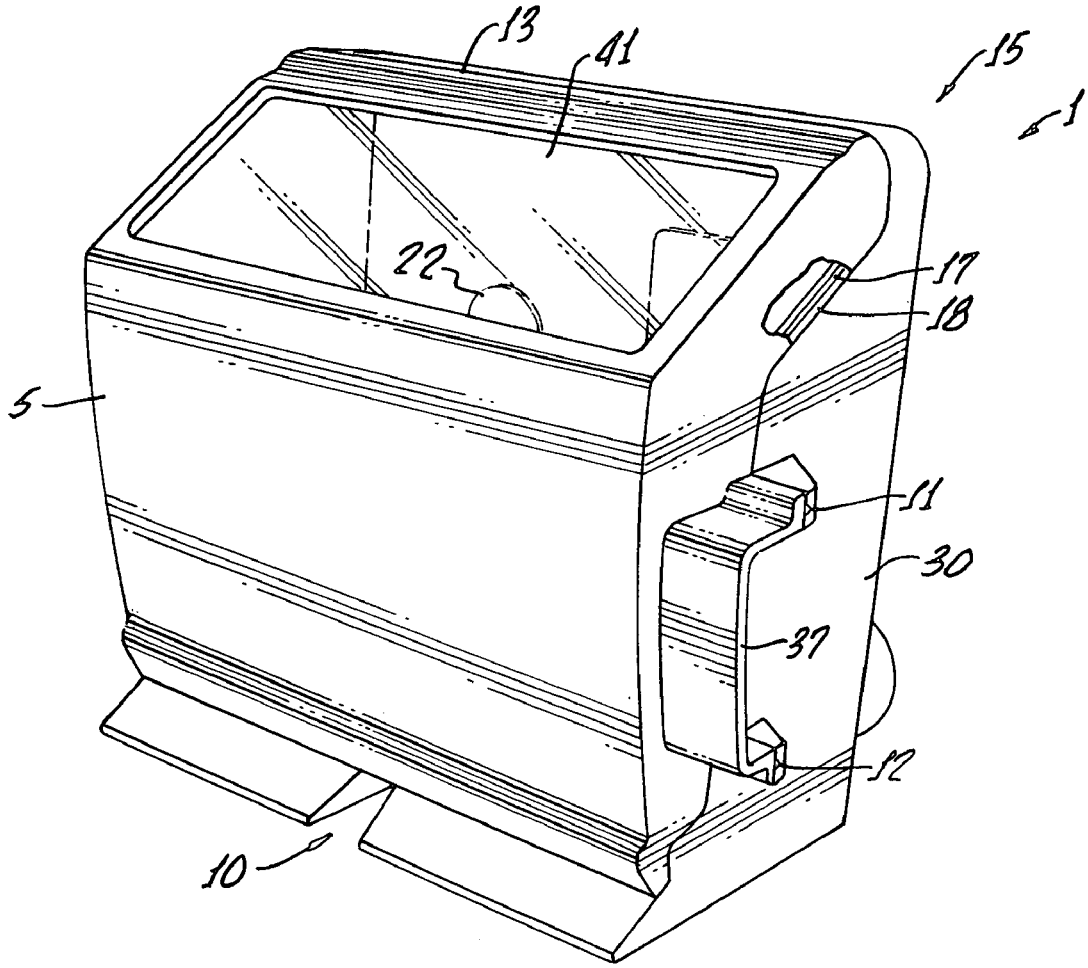
FIG. 2 shows the housing according to the invention of FIG. 1 with the cover closed.

In FIG. 2, housing 1 according to the invention is shown with housing cover 5 closed. Housing cover 5 closes a housing opening in housing base 15. For this purpose, housing cover 5 creates a seal between cover ridges 17 and housing base ridges 18 on housing base 15. When housing 1 is closed, the only openings that remain are the filament pass-through apertures 10, 11, 12, 13. The noise escaping through these openings is reduced by the fact that housing base 15 and housing cover 5 each have a reinforcement 37 in the area of filament pass-through apertures 11, 12 on the right side wall 30, so that filament pass-through apertures 11, 12 form an extended channel. Mounting position 22 of the nozzle is visible through inspection window 41 in housing cover 5.

A housing 1 for enclosing a nozzle is suggested, particularly an air covering nozzle or an air texturing nozzle 3, with at least one filament pass-through aperture 10, 11, 12, 13 having a filament pass-through aperture circumference 20 and a housing cover 5 that covers a housing opening in a housing base 15, housing cover 5 engaging with housing base ridges 18 on the housing base 5 by means of cover ridges 17, filament pass-through aperture 10, 11, 12, 13 being located in such manner on one of the housing base ridges 18 that part of filament pass-through aperture circumference 20 is formed by one of the cover ridges 17.

The invention is not limited to the embodiments described in the preceding text. A wide range of variants is conceivable, all of which draw on the characterizing features of the invention, even though their design may be fundamentally different.

We claim:

1. A housing for encasing a nozzle the housing comprising:

a housing base having ridges;

a housing cover having ridges engageable with the housing base ridges;

a plurality of filament pass-through apertures, the filament pass-through apertures having circumferences defined by engaged housing base ridges and housing cover ridges; and a filament retaining and guiding dogtooth disposed at each filament pass-through aperture, the dogtooth retaining the filament within a corresponding aperture when said housing cover is open.

2. The housing according to claim 1 wherein the filament pass-through apertures are disposed in the housing along filament infeed directions to the nozzle.

3. The housing according to claim 1 further comprising reinforcement disposed in an area of each filament pass-through aperture.

4. The housing according to claim 1 further comprising an inspection window disposed in the housing cover.

5. The housing according to claim 1 further comprising a hinge securing the housing cover to the housing base.

6. In a yarn processing machine a housing for encasing a nozzle the housing comprising:

a housing base having ridges;

a housing cover having ridges engageable with the housing base ridges;

a plurality of filament pass through apertures, the filament pass-through apertures having circumferences defined by engaged housing base ridges and housing cover ridges; and a filament retaining and guiding dogtooth disposed at each filament passing through aperture, the dogtooth retaining the filament within a corresponding aperture when said housing cover is open.

* * * * *